US008672687B2

(12) United States Patent
Shanbour, II et al.

(10) Patent No.: US 8,672,687 B2
(45) Date of Patent: Mar. 18, 2014

(54) DRY-ERASE BOARD WITH INSERTS

(75) Inventors: Alfred D. Shanbour, II, Franklin, TN (US); Matthew D. Green, Franklin, TN (US); Troy M. Birdsong, Thompson Station, TN (US)

(73) Assignee: Chameleon Corporation, Inc., Franklin, TN (US)

( * ) Notice: Subject to any disclaimer, the term of this patent is extended or adjusted under 35 U.S.C. 154(b) by 187 days.

(21) Appl. No.: 13/279,381

(22) Filed: Oct. 24, 2011

(65) Prior Publication Data

US 2013/0101979 A1 Apr. 25, 2013

(51) Int. Cl.
*B43L 1/00* (2006.01)

(52) U.S. Cl.
USPC ..... 434/408

(58) Field of Classification Search
USPC ..... 434/408, 416, 428, 429, 430; 40/611.1, 40/661
See application file for complete search history.

(56) References Cited

U.S. PATENT DOCUMENTS

| | | | | |
|---|---|---|---|---|
| 923,335 | A | 6/1909 | Cornelius | |
| 1,573,264 | A | 2/1926 | Mankameyer | |
| 1,757,287 | A | 5/1930 | Bildstein | |
| 4,852,282 | A | 8/1989 | Selman | |
| 5,110,295 | A | 5/1992 | Concra | |
| 5,457,905 | A | 10/1995 | Kaplan | |
| 5,599,189 | A | 2/1997 | Kees | |
| 5,635,265 | A | 6/1997 | Potokar | |
| 5,655,323 | A | 8/1997 | Lassoff | |
| 5,680,721 | A | 10/1997 | Hine, Jr. | |
| 5,785,528 | A | 7/1998 | Jones-Fenleigh et al. | |
| 6,241,528 | B1 | 6/2001 | Myers | |
| 6,464,507 | B1 * | 10/2002 | Bailey | 434/247 |
| 6,557,284 | B2 * | 5/2003 | Nolan | 40/574 |
| 6,618,974 | B2 * | 9/2003 | Szalay | 40/611.06 |
| 6,866,516 | B2 | 3/2005 | Smith et al. | |
| 6,893,266 | B2 | 5/2005 | Donelan | |
| 7,255,566 | B2 * | 8/2007 | Galbraith Coates | 434/408 |
| 7,354,273 | B2 | 4/2008 | Donelan | |
| 7,543,951 | B2 * | 6/2009 | Koerner et al. | 362/99 |
| 7,587,847 | B2 | 9/2009 | Lasher | |
| 7,874,842 | B2 | 1/2011 | Beno | |
| 7,901,213 | B1 * | 3/2011 | Beno | 434/412 |
| 7,963,772 | B1 * | 6/2011 | Blazvick | 434/408 |
| 2005/0022439 | A1 | 2/2005 | Crump | |
| 2006/0158621 | A1 * | 7/2006 | Kirchhoff | 353/119 |
| 2006/0237621 | A1 * | 10/2006 | Wolff et al. | 248/452 |
| 2007/0094904 | A1 * | 5/2007 | Frank et al. | 40/594 |
| 2007/0141546 | A1 * | 6/2007 | Kang et al. | 434/408 |
| 2009/0068632 | A1 * | 3/2009 | Thompson et al. | 434/416 |

* cited by examiner

*Primary Examiner* — Kurt Fernstrom
(74) *Attorney, Agent, or Firm* — Michael L. Leetzow, P.A.

(57) ABSTRACT

A new design for a dry-erase board allows for writing on a clear top surface or a second surface under the clear top surface. The dry-erase board includes an insert positioned between the clear top surface and a second surface, the insert being protected by the clear top surface.

22 Claims, 7 Drawing Sheets

DRY-ERASE BOARD WITH INSERTS

BACKGROUND OF THE INVENTION

Field of the Invention

A new design for a dry-erase board allows for writing on a clear top surface or a second surface under the clear top surface. The dry-erase board includes an insert positioned between the clear top surface and a second surface, the insert being protected by the clear top surface.

The inserts can changed by simply lifting the top surface and replacing it with another insert. The insert can be secured between the writing surfaces in a number of ways. The dry-erase boards are particularly useful in health care settings by allowing the staff to see current information at a glance and to update that information quickly. The use of the inserts also means that each area will be consistent in amount and type of information, without having to replace materials.

SUMMARY OF THE INVENTION

The present invention is directed to a dry-erase board that includes a rigid base member, the rigid base member having a surface suitable for use with a dry-erase marker, at least one projection extending from the rigid base member, the at least one projection for accepting a template, and a transparent cover adjustably mounted to the rigid base member, the transparent cover having a surface suitable for use with a dry-erase marker.

In some embodiments, the dry-erase board includes a frame at least partially attached to the rigid base member.

In other embodiments, at least a portion of the frame is attached to the transparent cover.

In some embodiments, the transparent cover is rotatably attached to the rigid base member.

In other embodiments, the dry-erase board includes magnetic areas for attaching magnetic elements to one of the rigid base member and the transparent cover.

In another aspect, the invention is directed to a dry-erase board that includes a rigid base member, the rigid base member having a surface suitable for use with a dry-erase marker, a transparent cover adjustably mounted to the rigid base member, the transparent cover having a surface suitable for use with a dry-erase marker, and at least one retaining member attached to one of the rigid base member and the transparent cover for accepting a template to be disposed between the rigid base member and the transparent cover.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
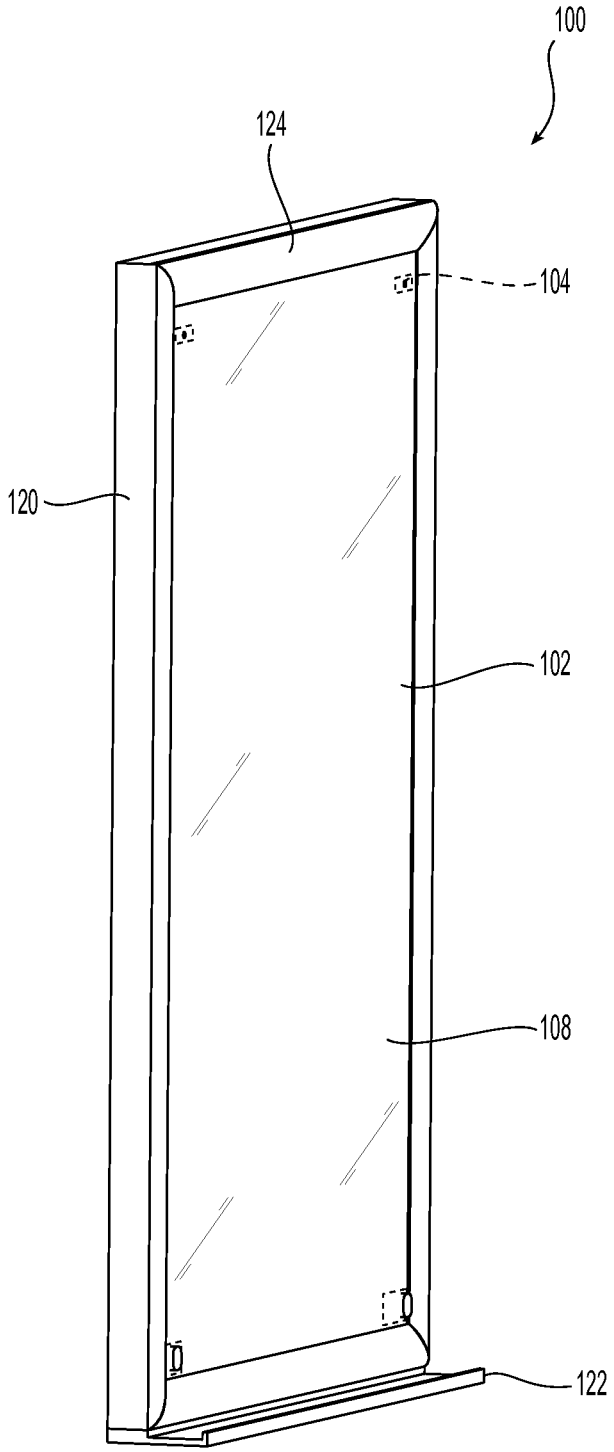
FIG. 1 is a front perspective view of one embodiment of a dry-erase board according to the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
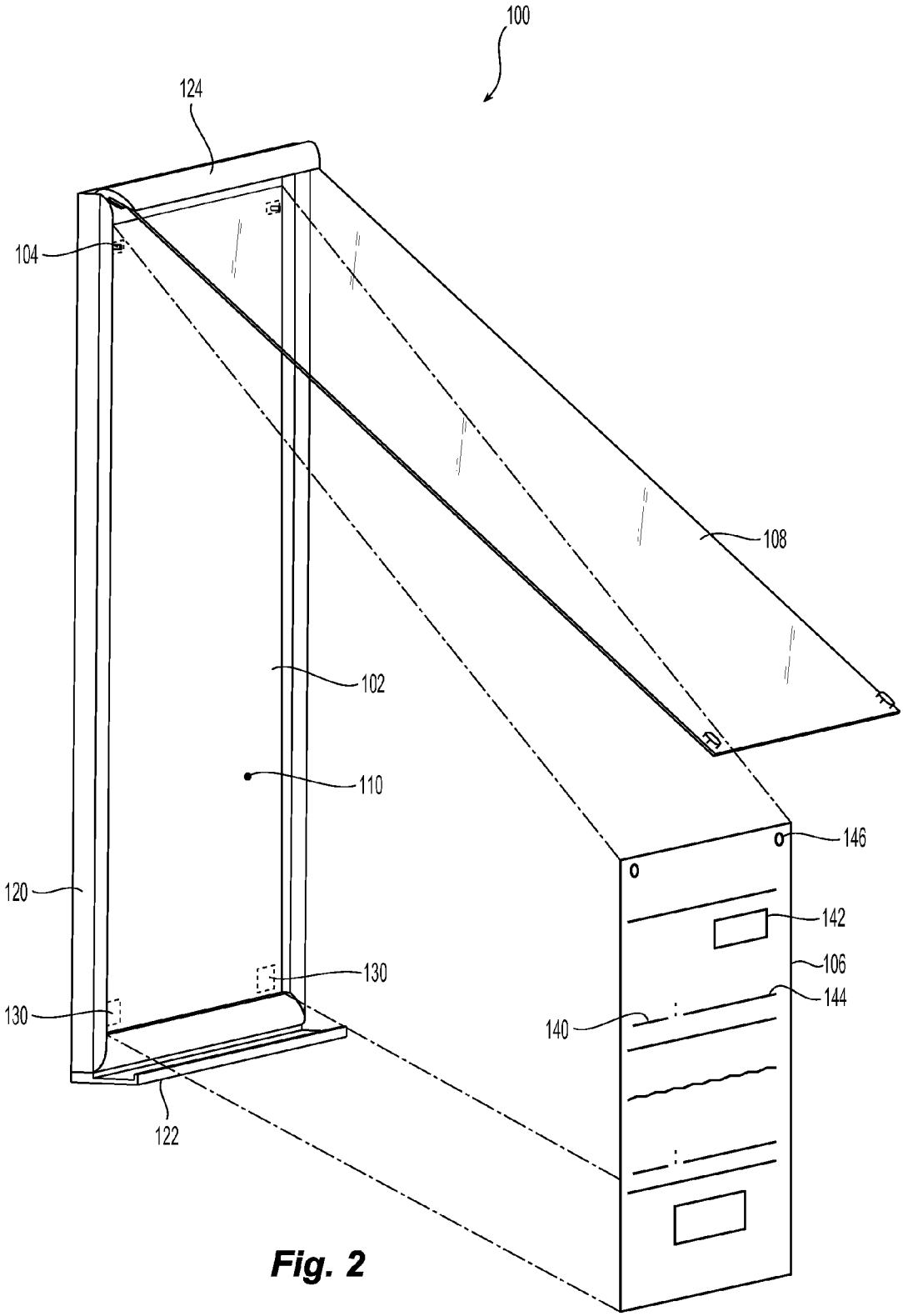
FIG. 2 is a front perspective view of the dry-erase board of FIG. 1 with the cover rotated upwards.
Figure 3:
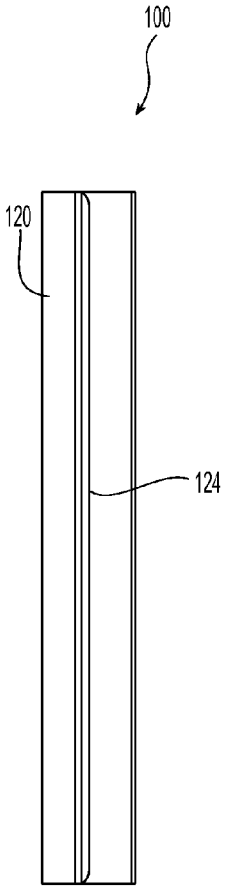
FIG. 3 is a top view of the dry-erase board of FIG. 1.
Figure 4:
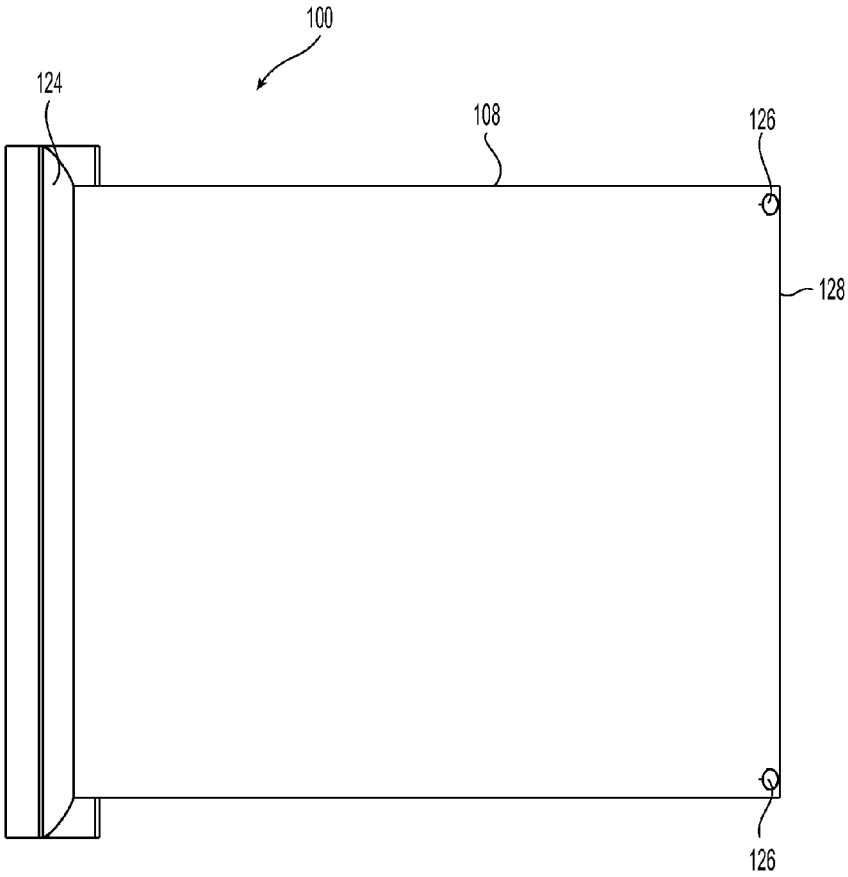
FIG. 4 is a top view of the dry-erase board of FIG. 1 with the cover rotated upwards.
Figure 5:
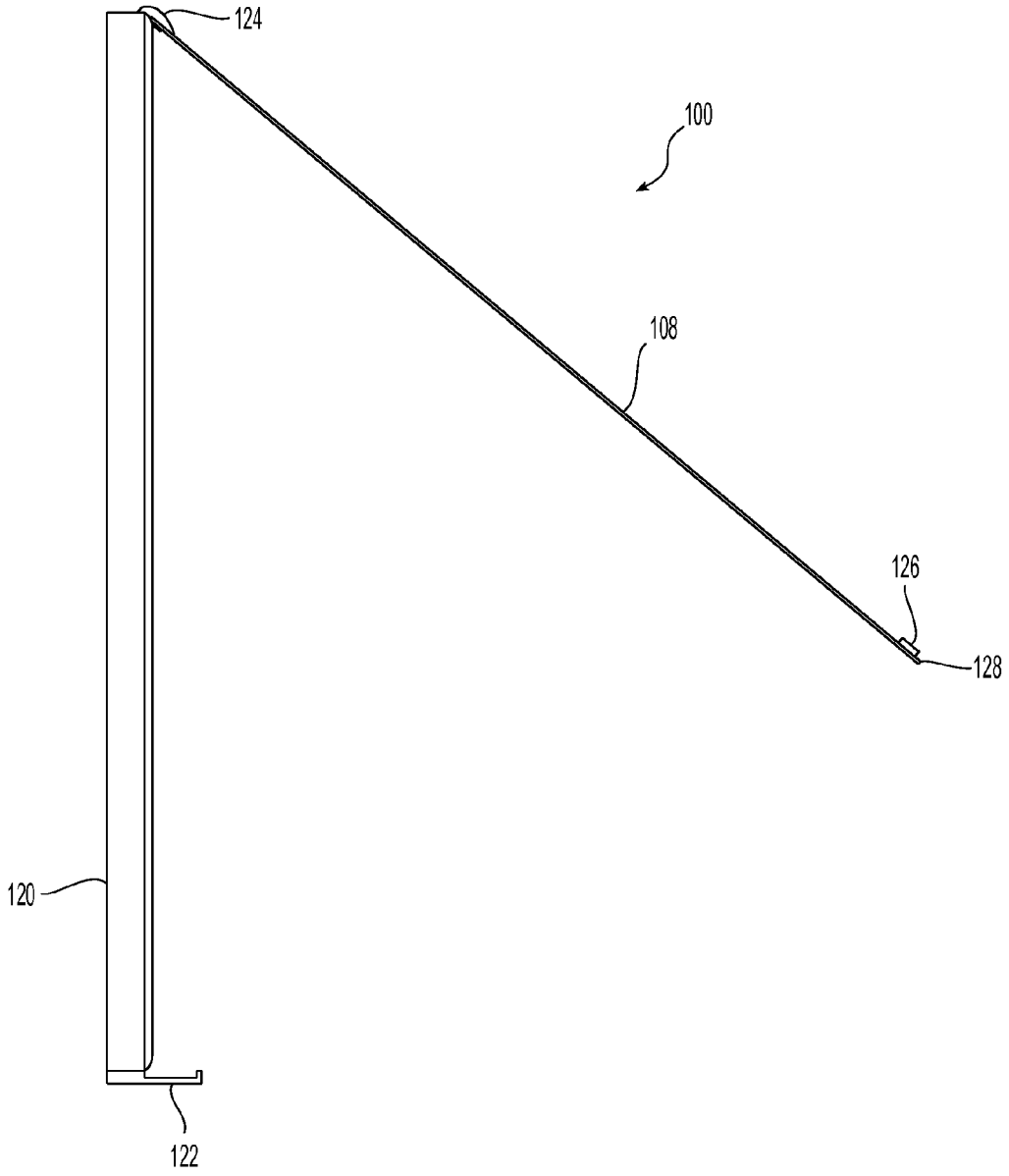
FIG. 5 is a side view of the dry-erase board of FIG. 1 with the cover rotated upwards.

One embodiment of the present invention illustrated in the figures is directed to a dry-erase board 100. The dry-erase board 100 has three main components: a rigid base member 102, at least one projection 104 to receive an optional insert 106 (see FIG. 2), and a transparent cover 108 that is adjustably mounted to the rigid base member 102. The rigid base member 102 has a surface 110 that is suitable for use with dry-erase markers. Such a rigid base member 102 includes a porcelain base with a dry-erase film as the surface 110. The rigid base member 102 may also have metal mixed into the porcelain or be used behind to porcelain to make the dry-erase board 100 magnetic. Preferably, the surface 110 of rigid base member 102 is what is known as a whiteboard. As illustrated in FIGS. 1-2, at least one projection 104 is associated with the rigid base member 102, the at least one projection 104 being two projections in the embodiment in FIGS. 1-5 mounted in the rigid base member 102 near the top thereof. The at least one projection 104 could also be a single element mounted in the middle of the rigid base member 102 also near the top. It is also contemplated that the at least one projection 104 could be other structures that would engage and secure the insert 106. Such structures might include clips, tacky surfaces, hook-and-loop fasteners, or any other appropriate structure.

While not required, the dry-erase board 100 may include a frame 120 extending around a periphery thereof. The dry-erase board 100 may also include a tray 122 extending outward from the bottom edge of the frame 120 and/or the rigid base member 102.

As best illustrated in FIG. 2, the transparent cover 108 is adjustably mounted to the rigid base member 102. In this embodiment, the transparent cover 108 is fixedly mounted to a top portion 124 of the frame 120. The top portion 124, which is separate from the remainder of the frame 120, is rotatable relative to the rigid base member 102 and the remainder of the frame 120. The transparent cover 108 is preferably mounted relative to the rigid base member 102 such that a space is provided between the transparent cover 108 and the rigid base member 102 to allow for the at least one projection 104 and the insert 106 to be positioned therebetween.

The transparent cover 108 is preferably made of acrylic (PMMA) or polycarbonate and has a surface for use with dry-erase markers. The transparent cover 108 preferably includes handles 126 adjacent a bottom edge 128 of the transparent cover 108. The handles 126 may include knobs, integral extensions of the cover 108, magnetic elements fixedly attached to a surface of the cover 108 or integrated with knobs, etc.

As best illustrated in FIG. 2, the rigid base member 102 may also have areas 130 that are either magnetic or ferromagnetic to cooperate with the handles 126 in the transparent cover 108 to hold the cover 108 against the rigid base member 102. Again, areas 130 may also include either the hook or the loop portion of a hook-and-loop fastener, a sticky surface, or other appropriate material.

An insert 106 to be used with a dry erase board 100 is illustrated in FIG. 2. The insert 106 is preferably dimensioned to fit over the rigid base member 102 and, if the dry-erase board 100 has a frame 120, within the frame 120. Insert 106 can be made from any suitable materials, including, but not limited to, paper, plastic, polypropylene, etc. Insert 106 also preferably has a coating to allow for use with a dry-erase marker. The insert 106 has areas of writing 140 adjacent to either open areas 142 or lines 144 and to assist the user of the dry-erase board 100 to include appropriate information on the dry-erase board 100. For example, the insert 106 includes as areas of writing 140, the name of the patient, the room number, the doctor, the nurse, medicine being given, last set of vital signs, etc. The insert 106 can also include open areas 142 that allow the user to see through the insert 106 to the rigid base member 102, where there may be information that does not change and is written on the rigid base member, e.g., the room number. In this case, the user would not want room numbers pre-printed on the insert 106, but also would not want the room number written where it could be easily removed-on the cover 108. The insert 106 would also include areas to cooperate with the at least one projection 104, which as illustrated in FIG. 2, are openings or holes 146.

Figure 6:
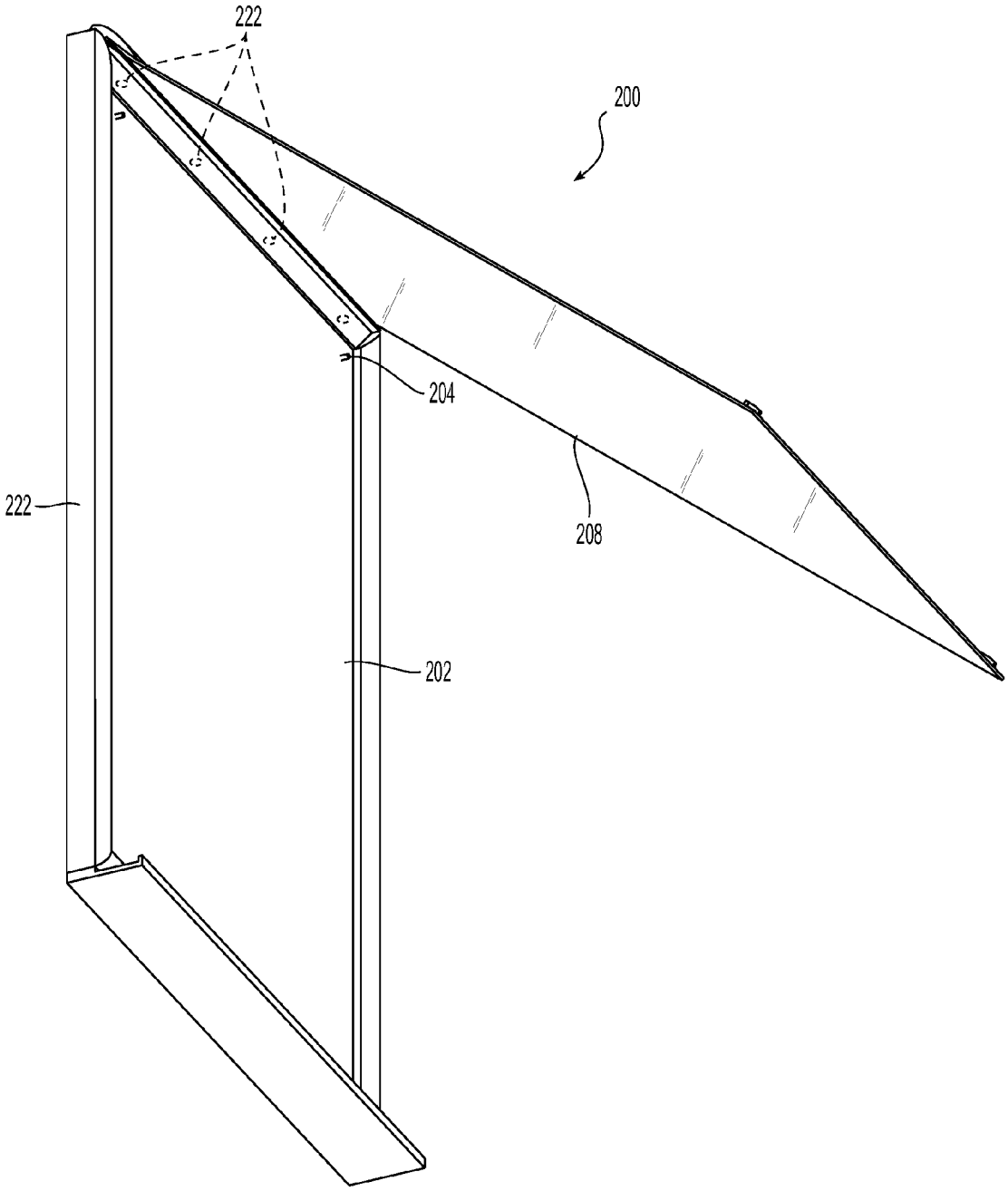
FIG. 6 is a front upwards perspective view of another embodiment of a dry-erase board according to the present invention with the cover rotated upwards.

An alternative embodiment of a dry-erase board 200 according to the present invention is illustrated in FIG. 6. The dry-erase board 200 also includes a rigid base member 202, at least one projection 204 to receive an optional insert (as in FIG. 2), and a transparent cover 208 that is adjustably mounted to the rigid base member 202. The dry-erase board 200 also includes a frame 220 around at least a portion of the periphery of the dry-erase board 200. The dry-erase board 200 preferably has lighting elements 222 to illuminate the dry-erase board 200 and, in particular, the rigid base member 202 and insert (not shown). The lighting elements 222, while illustrated on the top edge of the rigid base number 202, could be positioned anywhere around the edge of the dry-erase board 200 or even all the way around the dry-erase board 200.

Figure 7:
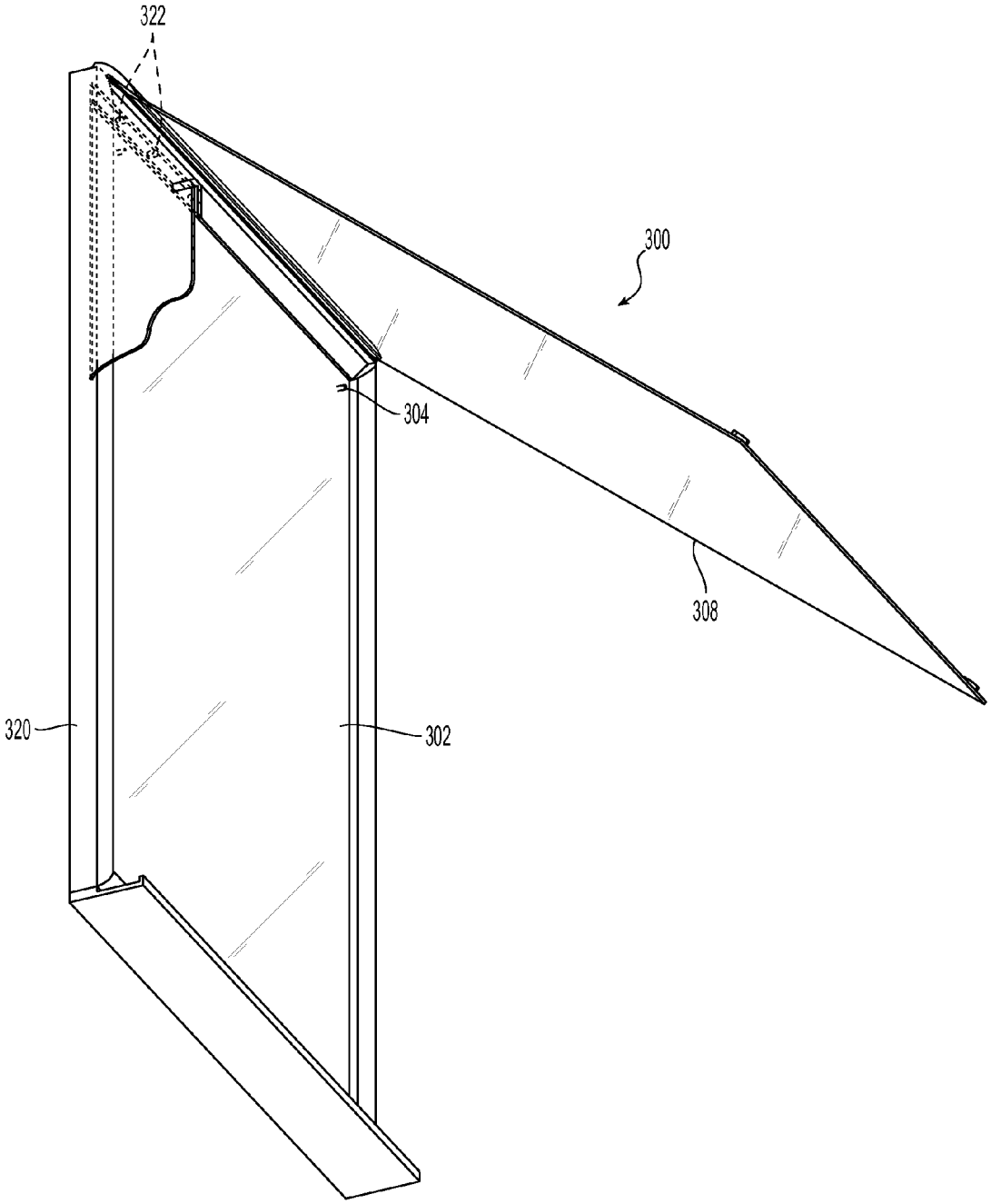
FIG. 7 is a front upwards perspective view of another embodiment of a dry-erase board according to the present invention with the cover rotated upwards.

Another embodiment of a dry-erase board 300 according to the present invention is illustrated in FIG. 7. The dry-erase board 300 also includes a rigid base member 302, at least one projection 304 to receive an optional insert (as in FIG. 2), and a transparent cover 308 that is adjustably mounted to the rigid base member 302. The dry-erase board 300 also includes a frame 320 around at least a portion of the periphery of the dry erase board 300. The rigid base member 302 of dry-erase board 300 is at least in part translucent. In this case, lighting elements 322 are placed behind the rigid base member 302 and illuminates the dry-erase board 300 from behind the rigid base member. The lighting elements 322 may also be variable in that the user/staff can adjust the brightness of the lighting elements so as not to affect the sleep of patients if the dry-erase board 300 is used in a hospital setting. Similarly, if the dry-erase board is placed in a highly lighted area, then more light may be necessary from the lighting elements 322. The lighting elements may be placed around the periphery of the dry-erase board 300, or directly behind the rigid base member 302.

Figure 8:
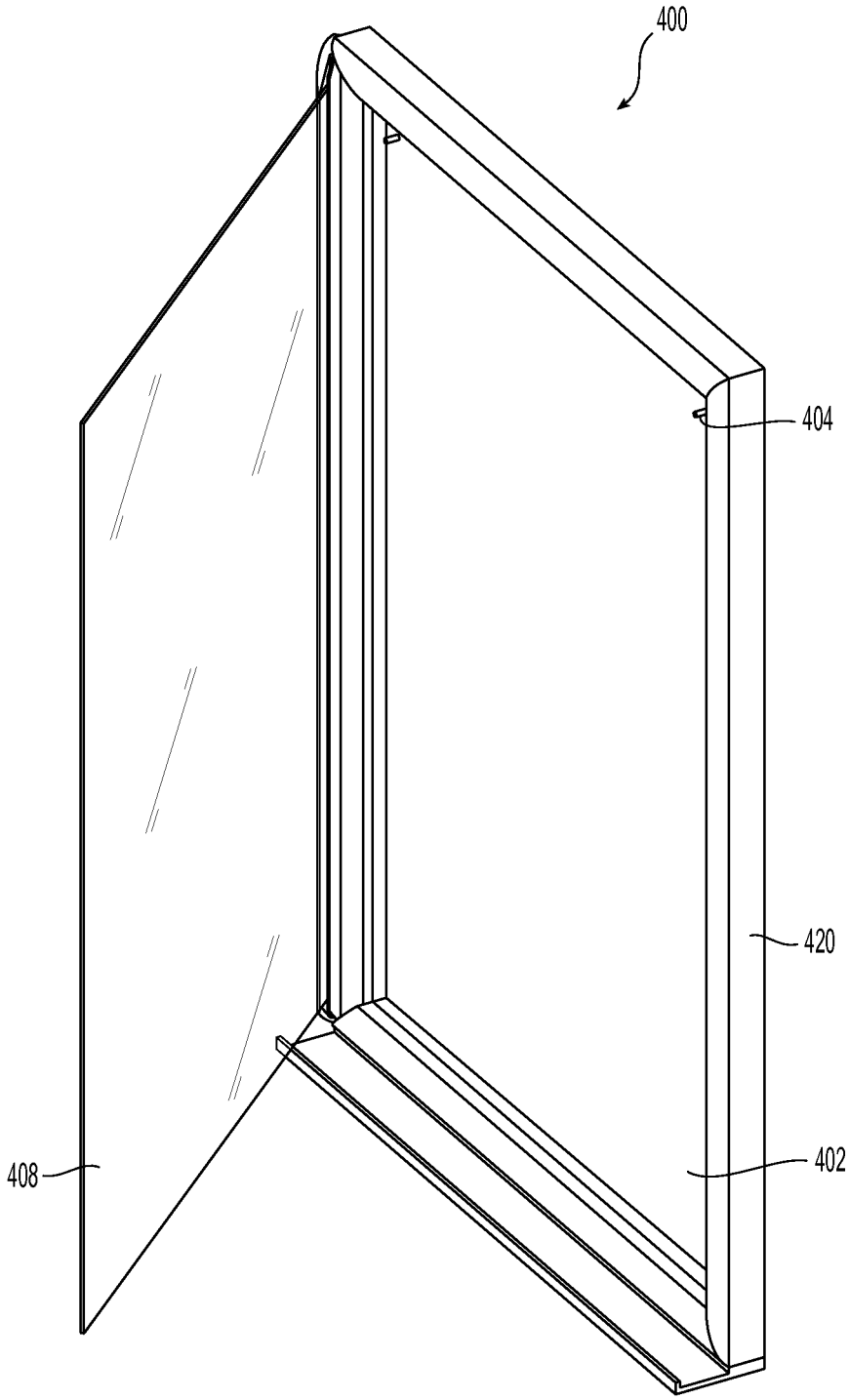
FIG. 8 is a front upwards perspective view of another embodiment of a dry-erase board according to the present invention with the cover rotated outward from one side.

Another embodiment of a dry-erase board 400 according to the present invention is illustrated in FIG. 8. The dry-erase board 400 also includes a rigid base member 402, at least one projection 404 to receive an optional insert (as in FIG. 2), and a transparent cover 408 that is adjustably mounted to the rigid base member 402. The dry-erase board 400 also includes a frame 420 around at least a portion of the periphery of the dry erase board 400. In this embodiment of dry-erase board 400, the cover 408 is hinged along one side rather than along the top of the dry-erase board 400. While the cover 408 is hinged along the left side, it may also be hinged along the right side and still be within the scope of the present invention. Hinging the cover 408 along one side may allow for easier and faster access to the rigid base member 402 to write on it or on the insert (not shown but similar to insert 106). The cover 408 is also illustrated as being attached to a portion of the frame 420, but could be directly hinged to the rigid base member 402. The dry-erase board 400 may also have lighting elements or a translucent rigid base member as described above.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

We claim:

1. A dry-erase board comprising:

a rigid base member, the rigid base member having a surface suitable for use with a dry-erase marker;

at least one projection extending from the rigid base member, the at least one projection for accepting a template; and a transparent cover adjustably mounted to the rigid base member, the transparent cover having a surface suitable for use with a dry-erase marker.

2. The dry-erase board according to claim 1, further comprising a frame at least partially attached to the rigid base member.

3. The dry-erase board according to claim 2, wherein at least a portion of the frame is attached to the transparent cover.

4. The dry-erase board according to claim 1, wherein the transparent cover is rotatably attached to the rigid base member.

5. The dry-erase board according to claim 1, wherein the at least one projection comprises two projections, the two projections configured to receive a template having a surface for use with a dry-erase marker.

6. The dry-erase board according to claim 1, further comprising magnetic areas in the rigid base member for attaching magnetic elements to one of the rigid base member and the transparent cover.

7. The dry-erase board according to claim 4, wherein the transparent cover is attached to a portion of a frame, the portion of the frame attached to the transparent cover being rotatably attached to the rigid base member.

8. The dry-erase board according to claim 1, wherein the template provides spaces for writing on the transparent cover with a dry-erase marker.

9. The dry erase board according to claim 1, wherein the rigid base member is at least partially backlit.

10. The dry-erase board according to claim 1, further comprising lighting elements around at least a portion of a periphery of the rigid base member.

11. A dry-erase board according to claim 1, wherein the transparent cover substantially covers the rigid base member.

12. A dry-erase board comprising:

a rigid base member, the rigid base member having a surface suitable for use with a dry-erase marker;

a transparent cover adjustably mounted to the rigid base member, the transparent cover having a surface suitable for use with a dry-erase marker; and at least one retaining member attached to one of the rigid base member and the transparent cover for accepting a template to be disposed between the rigid base member and the transparent cover.

13. The dry-erase board according to claim 12, wherein the rigid base member has at least one translucent portion, the translucent portion having a lighting source therebehind.

14. The dry-erase board according to claim 12, wherein the at least one retaining member is a projection.

15. The dry-erase board according to claim 12, wherein the at least one retaining member is a magnetic element, the magnetic element cooperating with a second magnetic element.

16. The dry-erase board according to claim 12, wherein the at least one retaining member is fixedly attached to one of the rigid base member and the transparent cover.

17. The dry-erase board according to claim 12, further comprising a template, wherein the template has a dry erase coating and provides spaces for writing on one of the transparent cover and the template with a dry-erase marker.

18. The dry-erase board according to claim 12, further comprising a frame at least partially attached to the rigid base member and wherein the transparent cover is attached to a portion of a frame, the portion of the frame attached to the transparent cover being rotatably attached to the rigid base member.

19. The dry-erase board according to claim 12, further comprising lighting elements around at least a portion of a periphery of the rigid base member.

20. A dry-erase board consisting of:

a rigid base member, the rigid base member having a surface suitable for use with a dry-erase marker;

a frame attached to the rigid base member, at least a portion of the frame rotatable relative to the base;

a transparent cover disposed between the rigid base member and the frame, the transparent cover having a surface suitable for use with a dry-erase marker and the frame is disposed substantially around the rigid base member and the cover; and at least one retaining member attached to one of the rigid base member and the transparent cover for accepting a template to be disposed between the rigid base member and the transparent cover.

21. A dry-erase board comprising:

a rigid base member, the rigid base member having a surface suitable for use with a dry-erase marker;

a frame attached to the rigid base member, at least a portion of the frame rotatable relative to the base; and a transparent cover disposed between the rigid base member and the frame, the transparent cover movable relative to the rigid base member and having a surface suitable for use with a dry-erase marker, and wherein the frame is disposed substantially around the rigid base member and the cover.

22. The dry-erase board according to claim 21, wherein the frame has at least two separate members, at least one of the at least two separate members being movable relative to another of the at least two separate members.

* * * * *